US008502845B2

(12) United States Patent
Kim

(10) Patent No.: US 8,502,845 B2
(45) Date of Patent: Aug. 6, 2013

(54) METHOD FOR CHANGING RESOLUTION AND DISPLAY APPARATUS AND SYSTEM USING THE SAME

(75) Inventor: Jong-keun Kim, Suwon-si (KR)

(73) Assignee: Samsung Electronics Co., Ltd., Suwon-Si (JP)

( * ) Notice: Subject to any disclaimer, the term of this patent is extended or adjusted under 35 U.S.C. 154(b) by 215 days.

(21) Appl. No.: 12/987,682

(22) Filed: Jan. 10, 2011

(65) Prior Publication Data

US 2011/0193898 A1 Aug. 11, 2011

(30) Foreign Application Priority Data

Feb. 5, 2010 (KR) ..... 10-2010-0011039

(51) Int. Cl.
*G09G 5/02* (2006.01)

(52) U.S. Cl.
USPC ..... 345/698; 345/204

(58) Field of Classification Search
USPC ..... 345/698
See application file for complete search history.

(56) References Cited

U.S. PATENT DOCUMENTS

| | | | |
|---|---|---|---|
| 7,079,128 | B2 | 7/2006 | Kim |
| 7,572,036 | B2 | 8/2009 | Yoon et al. |
| 2005/0128349 | A1 | 6/2005 | Takamori et al. |
| 2009/0273727 | A1 | 11/2009 | Kubota et al. |
| 2010/0023145 | A1 | 1/2010 | Yagura |

FOREIGN PATENT DOCUMENTS

| | | | |
|---|---|---|---|
| EP | 1914745 | A2 | 4/2008 |
| EP | 1944969 | A2 | 7/2008 |
| JP | 2008-067024 | * | 3/2008 |
| JP | 2008067024 | A | 3/2008 |
| KR | 10-2002-0074347 | A | 9/2002 |
| KR | 10-0480693 | B1 | 3/2005 |
| KR | 10-2006-0034021 | A | 4/2006 |
| KR | 10-2007-0085694 | A | 8/2007 |

OTHER PUBLICATIONS

Communication dated Jun. 14, 2011 from the European Patent Office in counterpart European Patent Application No. 11152296.7.

* cited by examiner

*Primary Examiner* — Amare Mengistu
*Assistant Examiner* — Shawna Stepp Jones
(74) *Attorney, Agent, or Firm* — Sughrue Mion, PLLC

(57) ABSTRACT

A method for changing a resolution and a display apparatus and system using the method are provided. The method for changing a resolution includes receiving an input indicating a resolution selected from among a plurality of resolutions, transmitting information of the selected resolution to an external device, receiving an image which has been processed based on the information of the selected resolution from the external device, and displaying the received image on a screen the display apparatus.

16 Claims, 5 Drawing Sheets

METHOD FOR CHANGING RESOLUTION AND DISPLAY APPARATUS AND SYSTEM USING THE SAME

CROSS-REFERENCE TO RELATED APPLICATION

This application claims priority from Korean Patent Application No. 10-2010-0011039, filed on Feb. 5, 2010 in the Korean Intellectual Property Office, the disclosure of which is incorporated herein by reference in its entirety.

BACKGROUND

1. Field

Apparatuses and methods consistent with the exemplary embodiments relate to changing a resolution of a display apparatus, and more particularly, to a method for changing a resolution using a display apparatus and a display apparatus and system using the method.

2. Description of the Related Art

Display apparatuses, such as monitors, receive a video signal from host apparatuses, such as personal computers, and output the video signal on a screen. Users can adjust a resolution of the display apparatus arbitrarily and watch an image that has been scaled in the host apparatus according to the adjusted resolution.

Recently, as contents of diverse formats and diverse resolutions are being provided, the users can select a suitable resolution for each content.

However, changing the resolution is an operation that may be difficult or inconvenient for general users perform and thus may hinder the users from enjoying the display of optimal contents on the screen. This problem becomes more significant for users who have difficulty seeing small letters or for users who are not familiar with handling the host apparatus or the display apparatus.

SUMMARY

Exemplary embodiments overcome the above disadvantages and other disadvantages not described above. However, it is understood that the exemplary embodiments are not required to overcome the disadvantages described above, and an exemplary embodiment may not overcome any of the problems described above.

The exemplary embodiments provide a method for changing a resolution, which facilitates a manipulation to change a resolution of a display apparatus, and a display apparatus and system using the method.

According to an aspect of an exemplary embodiment, there is provided a method for changing a resolution of a display apparatus in which information on a plurality of resolutions is stored, the method including: receiving an input indicating a resolution selected from among the plurality of resolutions, transmitting information of the selected resolution to an external device, and receiving an image which has been processed based on the information of the selected resolution from the external device, and displaying the received image a screen on the display apparatus.

The information on the plurality of resolutions may be information which is pre-stored based on an aspect ratio of the display apparatus.

The method may further include: receiving a list of resolutions which are supportable by the external device from the external device, and discriminating between a resolution included in the list of resolutions and a resolution excluded from the list of resolutions so that one of the plurality of resolutions that is included in the list of resolutions is selected.

If one of the plurality of resolutions is selectable through a manipulation of a button on the display apparatus, the discriminating prevents the resolution excluded from the list of resolutions from being selected and allows the resolution included in the list of resolutions to be selected when the button is manipulated.

If one of the plurality of resolutions is selectable through a manipulation of an OSD displayed on the display apparatus, the discriminating may disable an item corresponding to the resolution excluded from the list of resolutions and may enable an item corresponding to the resolution included in the list of resolutions when a manipulation of the OSD is input.

According to an aspect of another exemplary embodiment, there is provided a display apparatus which stores information on a plurality of resolutions, the display apparatus including: a display unit which displays an image, a input unit through which an input indicating a resolution selected from among the plurality of resolutions is received, a communication unit which transmits information of the selected resolution to an external device, and a controller which receives an image which has been processed based on the information of the selected resolution from the external device, and controls the display unit to display the processed image.

The information on the plurality of resolutions may be information which is pre-stored based on an aspect ratio of the display apparatus.

The communication unit may receive a list of resolutions which are supportable by the external device from the external device, and the controller may discriminate between a resolution included in the list of resolutions and a resolution excluded from the list of resolutions so that one of the plurality of resolutions that is included in the list of resolutions is selected.

If one of the plurality of resolutions is selectable through a manipulation of a button of the input unit, the controller prevents the resolution excluded from the list of resolutions from being selected and allows the resolution included in the list of resolutions to be selected when the button is manipulated.

If one of the plurality of resolutions is selectable through an OSD displayed on the display unit, the controller may disable an item corresponding to the resolution excluded from the list of resolutions and may enable an item corresponding to the resolution included in the list of resolutions when a manipulation of the OSD is input via the input unit.

According to an aspect of still another exemplary embodiment, there is provided a display system including: an output apparatus which outputs an image, and a processing apparatus which processes the image based on resolution information received from the output apparatus and provides the image to the output apparatus, wherein the output apparatus stores information on a plurality of resolutions, transmits information of a resolution to the processing apparatus if the resolution is selected from among the plurality of resolutions, and receives and outputs the image which has been scaled by the processing apparatus based on the information of the selected resolution.

BRIEF DESCRIPTION OF THE DRAWINGS

The above and/or other aspects will be more apparent by describing in detail exemplary embodiments, with reference to the accompanying drawings in which.

DETAILED DESCRIPTION OF THE EXEMPLARY EMBODIMENTS

Figure 1:
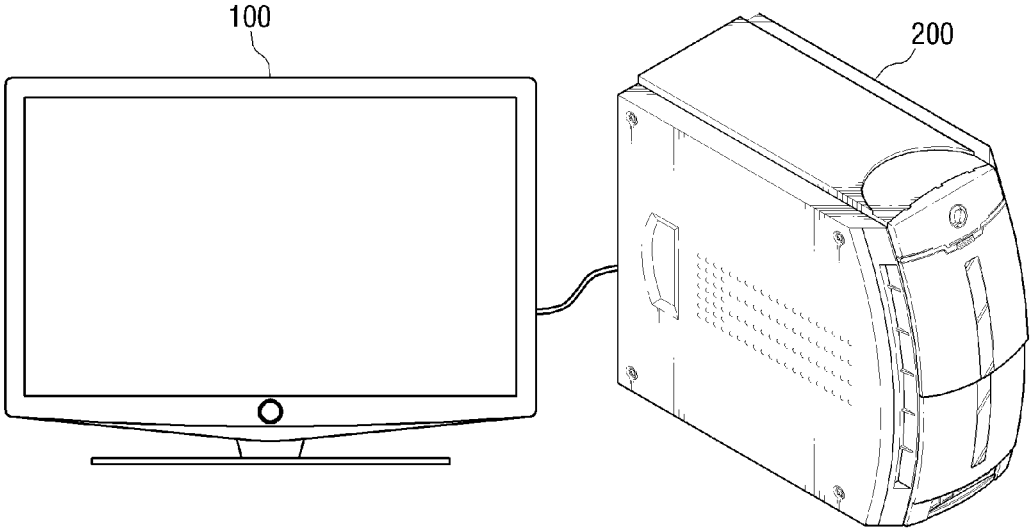
FIG. 1 is a view illustrating a display system according to an exemplary embodiment.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the inventive concept of the exemplary embodiments with unnecessary detail.

FIG. 1 is a view illustrating a display system according to an exemplary embodiment. As shown in FIG. 1, the display system includes a monitor 100 and a personal computer (PC) 200.

The monitor 100, which is a kind of display apparatus, receives a processed image from the PC 200 and outputs the processed image. In particular, the monitor 100 determines a resolution of an image to be displayed thereon based on a input command which is received from a input unit such as button (not shown) on the monitor 100 or a remote controller (not shown) for the monitor 100, transmits information of the determined resolution to the PC 200, receives an image which has been scaled according to the determined resolution from the PC 200, and displays the image.

The monitor 100 stores enhanced display information data (EDID) in a storage device installed in the monitor 100, such as an electrically erasable programmable read-only memory (EEPROM). The EDID contains resolutions and information of each resolution being matched with each other. Accordingly, a user can select a resolution by manipulating the input unit of the monitor 100 and information corresponding to the selected resolution can be transmitted to the PC 200.

On the other hand, the PC 200 stores a list of resolutions that can be supported by a processor installed in the PC 200, such as a graphic card, and transmits the list of resolutions to the monitor 100 so that the user can select a resolution from the list of resolutions.

This operation will be explained in detail below with reference to FIGS. 4A and 4B.

Figure 2:
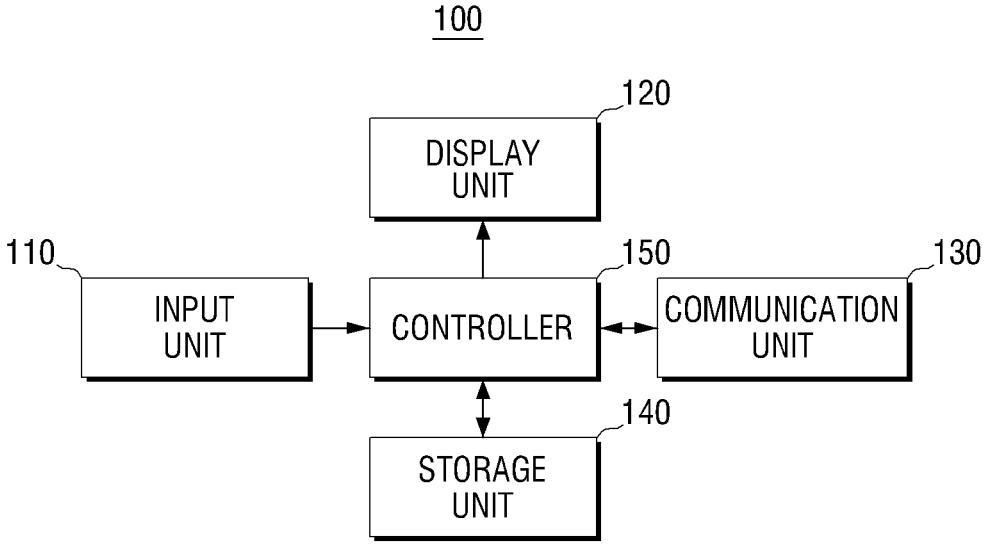
FIG. 2 is a block diagram illustrating a monitor according to an exemplary embodiment.

FIG. 2 is a block diagram illustrating the monitor 100 according to an exemplary embodiment. The monitor 100 includes a input unit 110, a display unit 120, a communication unit 130, a storage unit 140, and a controller 150.

The input unit 110 may be implemented as a button provided on a front panel of the monitor 100, and serves as an interface through which a command to change a resolution is input by the user.

The input unit 110 can include a plurality of buttons, such as a cursor button and a selection button, thereby enabling the user to select a resolution using the cursor button and to confirm the selection using the selection button. Alternatively, a single button can be provided such that a short press of the button selects a resolution and a long press of the button confirms the selection.

The display unit 120 receives and outputs an image which has been scaled according to the resolution selected by a manipulation of the input unit 110. In addition, the display unit 120 displays an on-screen display (OSD) so as to facilitate a user's input via manipulation of the input unit 110 for selecting a resolution, and changes the OSD according to the user's input to select a resolution or to confirm the selection.

The OSD may be included in the EDID described above.

The communication unit 130 serves as a passage to connect the monitor 100 and the PC 200 and transmits resolution information of a resolution selected by a manipulation of the input unit 110 from the monitor 100 to the PC 200. Also, the communication unit 130 receives an image which has been scaled based on the resolution information from the PC 200.

The communication unit 130 receives a list of resolutions that can be supported by the PC 200 from the PC 200.

The storage unit 140 stores programs for driving the monitor 100 and may be implemented as an EEPROM for storing the EDID described above. The EDID contains information regarding a model number, color coordinates, or an aspect ratio of the monitor 100, and also contains information regarding a resolution suitable for the model number or the aspect ratio.

The controller 150 controls the overall operation of the monitor 100.

More specifically, the controller 150 controls information of suitable resolutions stored in the storage unit 140 to be displayed on the screen according to a input command from a user through the input unit 110, and controls a resolution to be selected according to a input command from the user. Also, the controller 150 controls the communication unit 130 to transmit corresponding information of the selected resolution to the PC 200.

Also, the controller 150 controls an image which has been scaled in the PC 200 and received from the PC 200 through the communication unit 130 to be displayed on the display unit 120.

In addition, the controller 150 controls information regarding resolutions in the list of available resolutions received from the communication unit 130 from among the suitable resolutions stored in the storage unit 140 to be displayed on a screen. The controller 150 also controls resolutions stored in the storage unit 140 and also included in the list of available resolutions to be displayed discriminately from resolutions stored in the storage unit 140 but excluded from the list of available resolutions.

Figure 3:
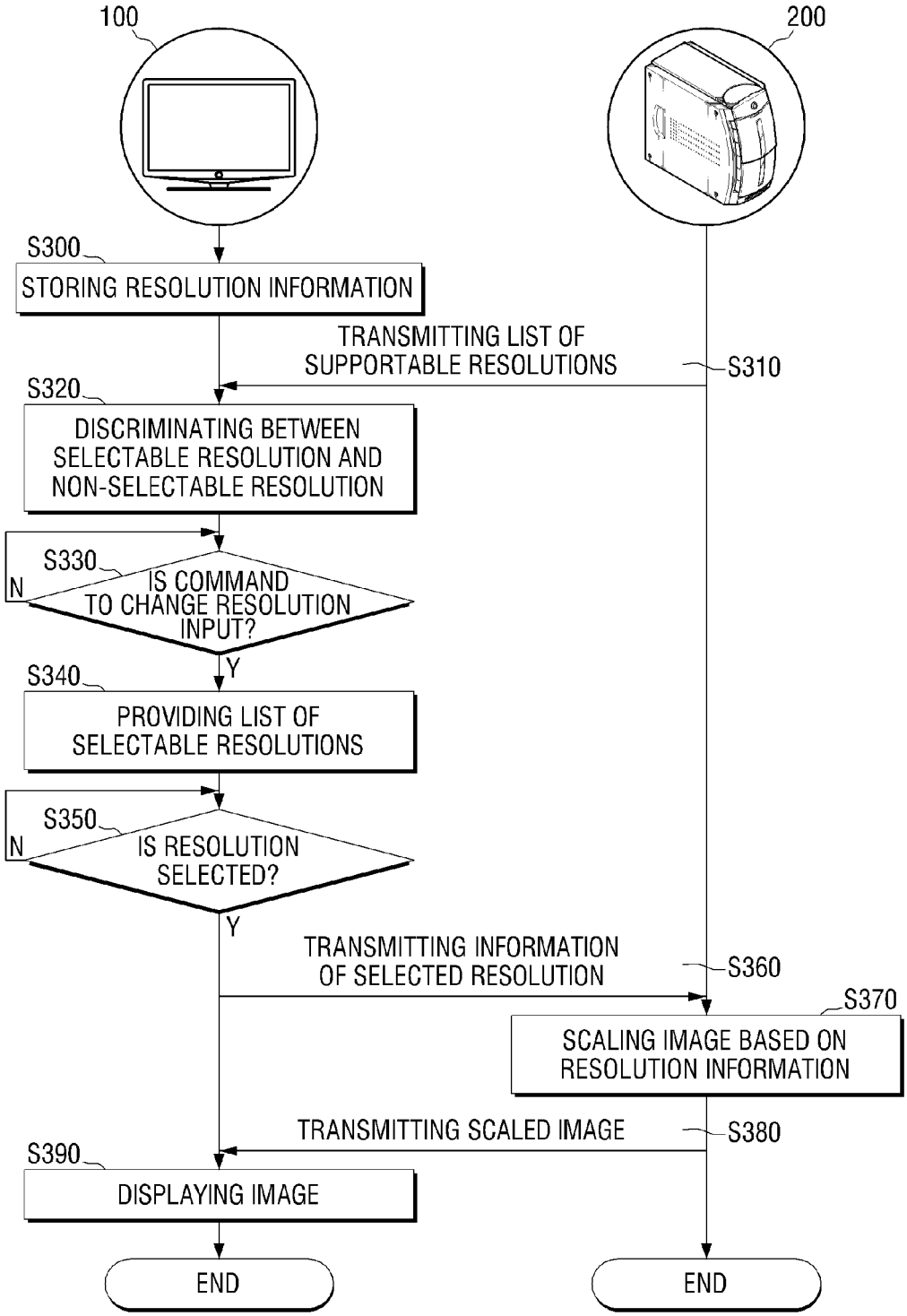
FIG. 3 is a flowchart illustrating a method for changing a resolution according to an exemplary embodiment.

FIG. 3 is a flowchart illustrating a method for changing a resolution according to an exemplary embodiment.

The monitor 100 stores information of a resolution or resolutions suitable for a model number or an aspect ratio or aspect ratios of a screen of the monitor 100 (S300). Such information may be stored in the aforementioned EDID.

If the PC 200 is connected to the monitor 100, the PC 200 transmits a list of resolutions that are supportable by a processor installed in the PC 200, such as a video card, to the monitor 100 (S310).

The monitor 100 compares the information of the suitable resolution(s) with the list of resolutions, thereby discriminating between a selectable resolution which can be selected by the user and a non-selectable resolution which cannot be selected by the user (S320). In particular, the selectable resolution is a resolution which is stored in the monitor 100 as a suitable resolution for the monitor 100 and is also included in the list of resolutions received from the PC 200. The non-selectable resolution is a resolution which is stored in the monitor 100 as a suitable resolution for the monitor 100 but is excluded from the list of resolutions received from the PC 200.

If a command to change a resolution is input from the user through the input unit 110 (S330-Y), a list of discriminated selectable resolutions is displayed for the user (S340). However, not only the list of selectable resolutions, but also the list of non-selectable resolutions may be displayed on the screen for the user. In the latter case, the list of non-selectable resolutions is disabled so that they cannot be selected.

If a resolution is selected by the user (S350-Y), the monitor 100 transmits resolution information corresponding to the selected resolution to the PC 200 (S360), and the PC 200 scales an image based on the received resolution information (S370). Also, the PC 200 transmits the scaled image to the monitor 100 (S380), and the monitor 100 displays the scaled image on the screen (S390).

Figure 4A:
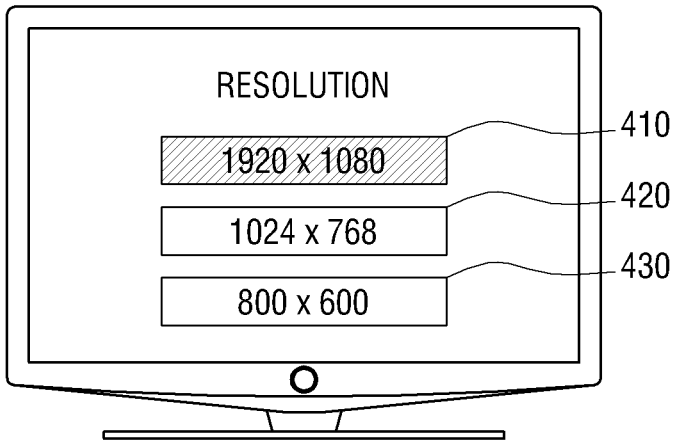
FIGS. 4A and 4B are views to explain a process of selecting a resolution.
Figure 4B:
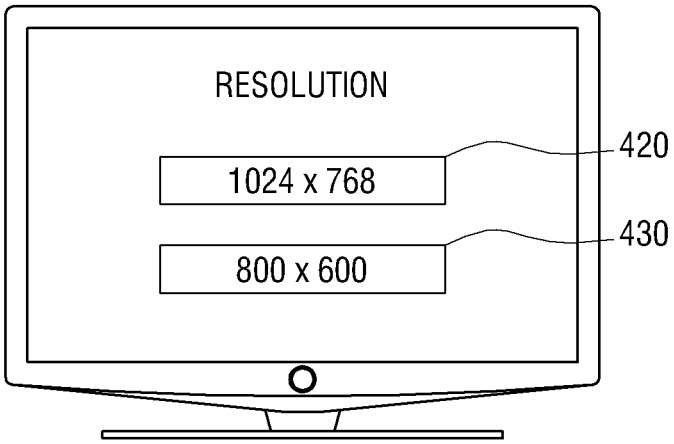

FIGS. 4A and 4B are views to explain a process of selecting a resolution. In FIGS. 4A and 4B, it is assumed that a resolution is selected by selecting an item corresponding to the resolution through an OSD. However, the resolution may be selected without an OSD being displayed.

FIG. 4A illustrates a case where both an item corresponding to a selectable resolution and an item corresponding to a non-selectable resolution are displayed on the screen.

In this example, an item 410 corresponding to a resolution of 1920*1080 is shaded, whereas an item 420 corresponding to a resolution of 1024*768 and an item 430 corresponding to a resolution of 800*600 are not shaded.

That is, the shaded item 410 indicates a resolution which cannot be selected by the user and the non-shaded items 420, 430 indicate resolutions which can be selected by the user.

As described above, the selectable resolution is a resolution which is stored in the monitor 100 as a suitable resolution for the monitor 100 and is also included in the list of resolutions received from the PC 200. On the other hand, the non-selectable resolution is a resolution which is stored in the monitor 100 as a suitable resolution for the monitor 100 but is excluded from the list of resolutions received from the PC 200.

FIG. 4B illustrates a case where only the items corresponding to selectable resolutions are displayed.

In FIG. 4B, only the items 420, 430 corresponding to the selectable resolutions 1024*768 and 800*600 are displayed.

Accordingly, the user can change the resolution of the display apparatus more easily and more simply through a manipulation of the input unit 110 of the monitor 100 or a manipulation of the OSD displayed on the screen.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method for changing a resolution of a display apparatus in which information on a plurality of resolutions is stored, the method comprising: displaying the plurality of resolutions including at least one resolution that is supportable by an external device and is selectable, and at least one resolution that is not supportable by the external device and is not selectable; receiving an input indicating a resolution selected from among the plurality of resolutions that are displayed; transmitting information of the selected resolution to an-the external device; receiving an image which has been processed based on the information of the selected resolution from the external device; and displaying the received image on a screen the display apparatus.

2. The method as claimed in claim 1, wherein the information on the plurality of resolutions is information which is pre-stored based on an aspect ratio of the display apparatus.

3. The method as claimed in claim 1, further comprising: receiving a list of resolutions which are supportable by the external device from the external device; and discriminating between a resolution included in the list of resolutions and a resolution excluded from the list of resolutions so that one of the plurality of resolutions that is included in the list of resolutions is selected.

4. The method as claimed in claim 3, wherein, if one of the plurality of resolutions is selectable through manipulation of an input unit of the display apparatus, the discriminating prevents the resolution excluded from the list of resolutions from being selected and allows the resolution included in the list of resolutions to be selected when the input unit is manipulated.

5. The method as claimed in claim 3, wherein, if one of the plurality of resolutions is selectable through manipulation of an on-screen display (OSD) displayed on the display apparatus, the discriminating disables an item corresponding to the resolution excluded from the list of resolutions and enables an item corresponding to the resolution included in the list of resolutions when the manipulation of the OSD is input.

6. A display apparatus which stores information on a plurality of resolutions, the display apparatus comprising: a display unit which displays the plurality of resolutions including at least one resolution that is supportable by an external device and is selectable, and at least one resolution that is not supportable by the external device and is not selectable; an image; an input unit that receives through which an input indicating a resolution selected from among the plurality of resolutions that are displayed; is received; a communication unit which transmits information of the selected resolution on to the external device; and a controller which receives an image which has been processed based on the information of the selected resolutions from the external device, and controls the display unit to display the processed image.

7. The display apparatus as claimed in claim 6, wherein the information of the plurality of resolutions is information which is pre-stored based on an aspect ratio of the display apparatus.

8. The display apparatus as claimed in claim 6, wherein the communication unit receives a list of resolutions which are supportable by the external device from the external device, wherein the controller discriminates between a resolution included in the list of resolutions and a resolution excluded from the list of resolutions so that one of the plurality of resolutions that is included in the list of resolutions is selected.

9. The display apparatus as claimed in claim 8, wherein, if one of the plurality of resolutions is selectable through manipulation of the input unit, the controller prevents the resolution excluded from the list of resolutions from being selected and allows the resolution included in the list of resolutions to be selected when the input unit is manipulated.

10. The display apparatus as claimed in claim 8, wherein, if one of the plurality of resolutions is selectable through an on-screen display (OSD) displayed on the display unit, the controller disables an item corresponding to the resolution excluded from the list of resolutions and enables an item corresponding to the resolution on included in the list of resolutions when manipulation of the OSD is input via the input unit.

11. A display system comprising: an output apparatus which outputs an image; and a processing apparatus which processes the image based on resolution information received from the output apparatus and provides the image to the output apparatus, wherein the output apparatus stores information on a plurality of resolutions, displays at least one resolution that is supportable by the processing apparatus and is selectable, and at least one resolution that is not supportable by the processing apparatus and is not selectable, transmits information of a resolution selected from among the plurality of resolutions that are displayed to the processing apparatus, and receives and outputs the image which has been scaled by the processing apparatus based on the information of the selected resolution.

12. A method for changing a resolution of a display apparatus, the method comprising: determining at least one selectable resolution from among resolutions supported by an external device, based on information regarding a plurality of resolutions stored in the display apparatus; displaying the at least one selectable resolution and at least one non-selectable resolution from among resolutions not supported by the external device; receiving an input indicating a selected resolution selected from among the at least one selectable resolution; transmitting information regarding the selected resolution to the external device; and receiving an image which has been processed based on the information regarding the selected resolution from the external device, and displaying the received image on a screen of the display apparatus.

13. The method of claim 12 further comprising, prior to determining the at least one selectable resolution, receiving from the external device information regarding the plurality of resolutions supported by the external device.

14. The method of claim 13 further comprising displaying information indicating the at least one selectable resolution on the screen of the display apparatus, wherein the input indicating the selected resolution is received while the information indicating the at least one selectable resolution is displayed on the screen of the display apparatus.

15. The method of claim 13, wherein the determining the at least one selectable resolution comprises determining the at least one selectable resolution and at least one non-selectable resolution from among the resolutions supported by the external device based on the information regarding the plurality of resolutions stored in the display apparatus, the method further comprising:

displaying information indicating the at least one selectable resolution and the at least one non-selectable resolution on the screen of the display apparatus, wherein the input indicating the selected resolution is received while the information indicating the at least one selectable resolution and the at least one non-selectable resolution is displayed on the screen of the display apparatus.

16. The method as claimed in claim 12, wherein the at least one selectable resolution is selectable through manipulation of an input unit on the display apparatus, and the at least one non-selectable resolution is prevented from selection through manipulation of the input unit.

* * * * *